United States Patent [19]

Okumura et al.

[11] 4,140,657

[45] Feb. 20, 1979

[54] GRANULAR DETERGENT COMPOSITION

[75] Inventors: Osamu Okumura, Funabashi; Hiroshi Nishio, Chiba; Ryuichi Nakagawa, Narashino; Takashi Ikeuchi, Funabashi, all of Japan

[73] Assignee: The Lion Fat & Oil Co., Ltd., Tokyo, Japan

[21] Appl. No.: 806,055

[22] Filed: Jun. 13, 1977

[30] Foreign Application Priority Data

Jun. 18, 1976 [JP] Japan ..... 51-71837

[51] Int. Cl.[2] ..... C11D 1/37; C11D 3/04

[52] U.S. Cl. ..... 252/551; 252/531; 252/532; 252/533; 252/534; 252/536; 252/550; 252/552; 252/555

[58] Field of Search ..... 252/531, 532, 533, 536, 252/550, 551, 552, 555

[56] References Cited

U.S. PATENT DOCUMENTS

| | | | |
|---|---|---|---|
| 3,544,475 | 12/1970 | Tomiyama et al. | 252/555 |
| 3,793,233 | 2/1974 | Rose et al. | 252/547 |
| 3,892,680 | 7/1975 | Benjamin et al. | 252/532 |
| 3,951,877 | 4/1976 | Okumura et al. | 252/526 |
| 3,963,649 | 6/1976 | Spadini et al. | 252/546 |
| 3,979,340 | 9/1976 | Klisch | 252/548 |
| 3,980,588 | 9/1976 | Rubinfeld | 252/548 |
| 4,013,577 | 3/1977 | Wixon | 252/109 |

FOREIGN PATENT DOCUMENTS

| | | |
|---|---|---|
| 987417 | 3/1965 | United Kingdom. |
| 1221646 | 2/1971 | United Kingdom. |

*Primary Examiner*—P.E. Willis, Jr.

*Attorney, Agent, or Firm*—Blanchard, Flynn, Thiel, Boutell & Tanis

[57] ABSTRACT

A granular detergent composition which comprises a mixture of surface active agents consisting of alkyl sulfate (AS) expressed by the general formula $ROSO_3M$ (wherein R represents straight chain or branched chain alkyl group having 14 – 15 carbon atoms on the average, and M represents alkali metal or alkaline earth metal), an alkali metal or an alkaline earth metal, α-olefin sulfonate (AOS) having 12 – 18 carbon atoms and polyoxyethylene alkyl ether sulfate (AES) expressed by the general formula $R'O(C_2H_4O)_nSO_3M'$ (wherein R' represents straight chain or branched chain alkyl group having 8 – 12 carbon atoms on the average, n is an integer in the range of 1 – 8, and M' represents an alkali metal or an alkaline earth metal), at a mixing ratio within the hatched area bounded by points a, b, c, d, e and f in the appended drawing, said mixture of surface active agents being present in an amount of 20 – 40 wt.% based on the gross weight of said composition, and said composition containing substantially no phosphates, demonstrates a rich foaming under normal conditions for cleansing and displays a satisfactory easiness in rinsing.

2 Claims, 1 Drawing Figure

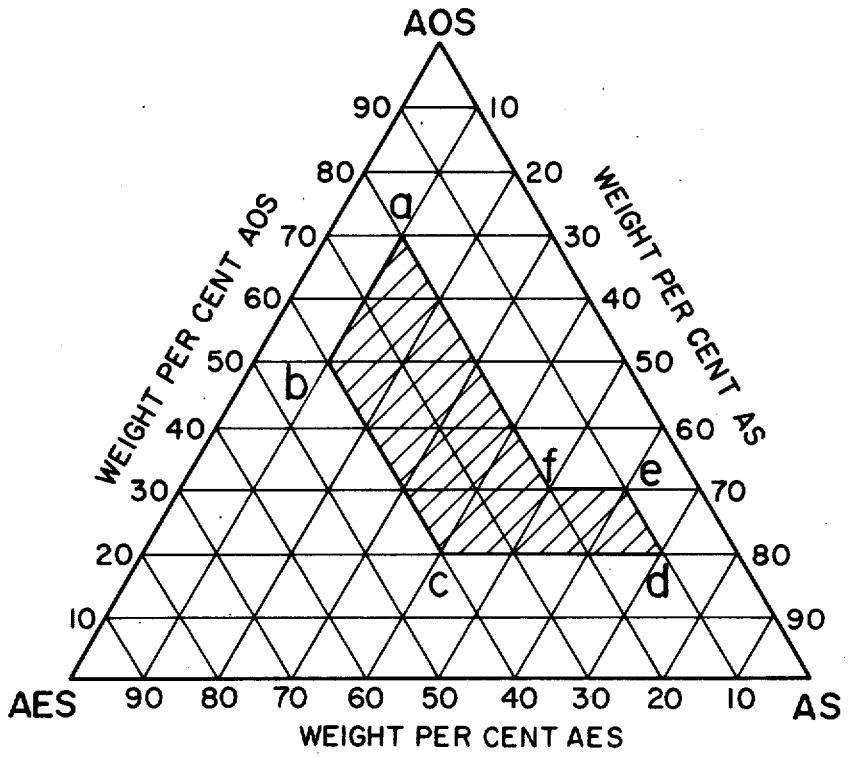
AOS
AES
AS
WEIGHT PER CENT AOS
WEIGHT PER CENT AS
WEIGHT PER CENT AES
90
80
70
60
50
40
30
20
10
a
b
c
d
e
f

GRANULAR DETERGENT COMPOSITION

BACKGROUND OF THE INVENTION (a) Field of the Invention

The present invention relates to a granular detergent composition which comprises substantially no phosphates.

(b) Description of the Prior Art

As detergents for domestic use for the purpose of removing stains from clothes, granular detergents are popular, and general users usually judge the detergency of these granular detergents by the degree of foaming at the time of cleansing. Therefore, in the case of detergents for domestic use, a rich foamability at the time of cleansing is required as an indispensable property, as well as superiority in detergency per se. Besides, a property of scarcely giving rise to foams when the concentration of detergent has become low, or at the time of rinsing, that is, the so-called suds-controlling property, is also indispensable to detergents for domestic use from the viewpoint of economy of water resources and labor-saving in washing.

Heretofore, detergents consisting essentially of a variety of surface active agents, sodium tripolyphosphate and suds-controlling agent (also known as 'rinsing agent', such as tallow soap) have predominated in the granular detergents for domestic use that have both of the foregoing properties. However, after detergents of such a composition have been used, and the waste water after washing containing same is flowed into rivers and lakes, various grave public nuisances occur. That is to say, the phosphorus component of the detergent is said to promote over-nutrition of rivers and lakes and enhance their bio-productivity abnormally, thereby accelerating the ageing of them. Besides, the surface active agents would accelerate the foaming along waterways, such as river, and dams, entailing the so-called public nuisance due to foam.

BRIEF DESCRIPTION OF THE DRAWING

The appended drawing is a three component system equilibrium diagram indicating the mixing ratio (by weight) of a mixture of alkyl sulfate (AS), α-olefin sulfonate (AOS) and polyoxyethylene alkyl ether sulfate (AES) contained in a detergent composition according to the present invention.

point a: AOS/AES/AS = 7/2/1
point b: AOS/AES/AS = 5/4/1
point c: AOS/AES/AS = 2/4/4
point d: AOS/AES/AS = 2/1/7
point e: AOS/AES/AS = 3/1/6
point f: AOS/AES/AS = 3/2/5.

SUMMARY OF THE INVENTION

Aiming at solving the problems of public nuisances as stated above, the present inventors have energetically conducted studies on how to dephosphorize detergents and so forth, and they have come to develop a detergent which comprises no sodium tripolyphosphate and nevertheless has a high detergency, displays rich foaming at the time of cleansing and is easy to rinse out by virtue of the employment of surface active agents having a satisfactory biodegradability.

To be precise, the present invention provides a dephosphorized granular detergent composition which comprises a mixture of surface active agents consisting of alkyl sulfate (AS) expressed by the general formula $ROSO_3M$ (wherein R represents straight chain or branched chain alkyl group having 14 - 15 carbon atoms on the average, and M represents an alkali metal or an alkaline earth metal), an alkali metal or alkaline earth metal α-olefin sulfonate (AOS) having 12 - 18 carbon atoms and polyoxyethylene alkyl ether sulfate (AES) expressed by the general formula $R'O(C_2H_4O)_n$-$SO_3M'$ (wherein R' represents straight chain or branched chain alkyl group having 8 - 12 carbon atoms on the average, n is an integer in the range of 1 - 8, and M' represents alkali metal or alkaline earth metal), at a mixing ratio within the hatched area bounded by points a, b, c, d, e and f in the appended drawing, wherein the amount of said mixture of surface active agents is from 20 - 40 wt.% based on the gross weight of said composition.

Referring to the drawing, point a is a composition containing 70 wt.% AOS, 20 wt.% AES and 10 wt.% AS; point b is a composition containing 50 wt.% AOS, 40 wt.% AES and 10 wt.% AS; point c is a composition containing 20 wt.% AOS, 40 wt.% AES and 40 wt.% AS; point d is a composition containing 20 wt.% AOS, 10 wt.% AES and 70 wt.% AS; point e is a composition containing 30 wt.% AOS, 10 wt.% AES and 60 wt.% AS; and point f is a composition containing 30 wt.% AOS, 20 wt.% AES and 50 wt.% AS.

α-olefin sulfonates suitable for use herein are obtained by subjecting an α-olefin (which contains less than 10% an inner-or vinylidene-type olefin) having 12 - 18 carbon atoms, inclusive of mixtures of these olefins prepared by wax-cracking process, ethylene polymerization process with Ziegler's catalyst or by another process, to sulfonation by the use of a conventional continuous thin film type sulfonator, followed by neutralization and hydrolysis in succession.

A detergent composition according to the present invention consists essentially of such a mixture of surface active agents as defined above and is manufactured by the spray drying method like the conventional granular detergent compositions. However, in the case where the mixing ratio of the components deviates from the range specified in the appended drawing, even though the detergency of the product is practically equal to that of the detergent compositions of the present invention within said range, a rich foaming and a satisfactory easiness in rinsing cannot be expected therefrom. Besides, in the case where the content of said mixture of surface active agents is more than 40 wt.%, not only does it become difficult to manufacture the intended detergent, but also there are caused such troubles as foaming of rivers, wild growth of algae in rivers and lakes, etc., and therefore both cases are undesirable. The alkyl group of the polyoxyethylene alkyl ether sulfate (AES) to be used herein has desirably in the range of 8 - 12 carbon atoms on the average, and the average number of ethylene oxide units is desirably in the range of 1 - 8. In the case where said average number of carbon atoms is less than this, there takes place deterioration of the detergency and lowering of the foamability, while in the case where it is more than this, even though the detergency as well as the foamability is satisfactory, the easiness in rinsing deteriorates remarkably, and therefore both cases are undesirable.

Besides, in the case where the number of ethylene oxide units of AES is very small or zero, the foamability becomes low, while in the case where it is increased to be more than 9, the hydrophilic property of it becomes so strong that deterioration of the foamability is remarkable, and therefore both cases are undesirable. The optimum number of ethylene oxide units of AES is in the range of 1 - 8.

Further, the alkyl group of alkyl sulfate (AS) to be used herein desirably contains in the range of 14 - 15 carbon atoms on the average. In the case where said average number of carbon atoms is less than this, the hydrophilic property of it becomes so strong that deterioration of the foamability takes place, while in the case where it is more than this, the solubility of the alkyl sulfate becomes so poor that the detergency as well as the foamability deteriorates, and therefore both cases are undesirable. In this connection, in the field of phosphorus-free detergents as described above, a detergent composition superior in detergency, foamability and the easiness in rinsing can be realized only by combining AS having 14 - 15 carbon atoms on the average, AOS having 12 - 18 carbon atoms on the average and AES having 8 - 12 carbon atoms on the average and 1 - 8 ethylene oxide unit on the average, and if any one of these three components is replaced by alkylbenzene sulfonate (LAS) which is commonly employed in conventional detergents, it will lead to deterioration of foamability and easiness in rinsing, thereby making the product unqualified for an article of commerce.

In addition to the foregoing essential components, a detergent composition according to the present invention further comprises water, inorganic or organic builders (excluding phosphate-type builders) such as silicate, carbonate, citrate, etc., fluorescent whitening agent, anti-caking agent, anti-redeposition agent, foam-stabilizer, perfume, dye, etc. in a total amount of 60 - 80 wt.%.

Hereunder are enumerated the merits of the detergent composition according to the present invention:

(1) It provides rich foaming at the time of cleansing (under the normal conditions for cleansing in general households) and can give a feeling of satisfaction while using to the users.

(2) It can display a sufficient foaming at the time of cleansing employing water having a temperature ranging from low to high and a hardness ranging from low to high.

(3) It displays a very satisfactory easiness in rinsing despite it does not comprise any conventional suds-controlling agent or sodium tripolyphosphate known to be remarkably effective in providing the easiness in rinsing.

(4) It is of course possessed of a detergency comparable with the conventional detergent compositions.

DESCRIPTION OF THE PREFERRED EMBODIMENTS

In the following Examples the present invention will be further elucidated. In this context, the composition of the granular detergent and the test method are as follows:

| | | |
|---|---|---|
| Composition: | Surface active agents in total | 20% |
| | sodium silicate ($SiO_2/Na_2O$ = 2/1) | 20% |
| | sodium carbonate | 30% |
| | sodium sulfate | 18% |
| | carboxymethyl cellulose, fluorescent whitening agent and water | 12% |

Test method:

(1) Test of detergency

A test piece of cloth (made of cotton) is attached to the collar of a shirt, and after wearing for 2 - 7 days, the stained test piece of cloth is detached from the shirt and bisymmetrically cut into two halves, whereby 2 sets of 20 pieces are prepared. Meanwhile, a knit cotton undershirt worn for 2 - 3 days' is bisymmetrically divided into two halves. Then, one 20-piece set of said stained test pieces of cloth and one half of said stained undershirt are washed with a standard detergent while the other 20-piece set of stained test pieces of cloth and the other half of said stained undershirt are washed with a sample detergent according to the present invention for 10 minutes, respectively, by means of an impeller-type electric washing machine under the conditions which are 0.1% in concentration of detergent, 25° C. in temperature of liquid, and 30:1 in bath ratio, and thereafter are subjected to 3 minutes' rinsing two times, respectively. Each pair of pieces of test pieces of cloth after cleansing are then compared and judged with the unaided eye, and the cleanliness of all the test pieces of cloth thus examined is classified into 5 grades by giving 5 marks to a test piece of cloth completely got rid of stains while giving 1 mark to one having stains scarcely removed. Next, the examination marks given to the detergency of each sample detergent are totaled, this total is divided by the examination total marks given to the detergency of the standard detergent and then multiplied by 100, and the value thus obtained is regarded as an index of detergency of each sample detergent.

(2) Test of foamability

The foamability of the detergent is valued by leveling off the foams present after washing in the test method under (1) above on the whole surface of the water, measuring the foam height at 3 places, and taking the average.

(3) Test of easiness in rinsing

The condition of residual foams is evaluated with respect to the rinsings after twice rinsing in the test method under (1) above by applying the following criteria:

A: no foam is observed.

A': a trace of white, foam-like substance is observed on the surface of the water.

B: presence of a small quantity of foam is observed.

C: presence of a large quantity of foam is observed.

In this connection, the standard detergent herein is composed of 20 wt.% of sodium alkylbenzene sulfonate, 20 wt.% of sodium tripolyphosphate, 10 wt.% of sodium silicate, ($SiO_2/Na_2O$=2/1) 5 wt.% of sodium carbonate, 1 wt.% of CMC, 10 wt.% of water and 34 wt.% of sodium sulfate.

EXAMPLE 1.

| | Constituent surface active agent (%) | | | Detergency | Foam height at the time of cleansing (mm) | Easiness to rinse out |
|---|---|---|---|---|---|---|
| | AS[1)] | AOS[2)] | AES[3)] | | | |
| I-1 | 14 | 4 | 2 | 100 | 15 | A |
| I-2 | 11 | 4 | 5 | 100 | 15 | A |
| I-3 | 8 | 4 | 8 | 98 | 15 | A |
| I-4 | 5 | 7 | 8 | 98 | 15 | A |

-continued

| | Constituent surface active agent (%) | | | Deter-gency | Foam height at the time of cleansing (mm) | Easi-ness to rinse out |
|---|---|---|---|---|---|---|
| | AS[1)] | AOS[2)] | AES[3)] | | | |
| I-5 | 2 | 10 | 8 | 98 | 15 | A |
| I-6 | 2 | 14 | 4 | 100 | 16 | A' |
| I-7 | 6 | 10 | 4 | 100 | 20 | A' |
| I-8 | 8 | 8 | 4 | 100 | 20 | A' |
| I-9 | 10 | 6 | 4 | 100 | 17 | A' |
| I-10 | 12 | 6 | 2 | 100 | 15 | A |
| I-11 | 8 | 6 | 6 | 99 | 20 | A |
| I-12 | 6 | 8 | 6 | 99 | 17 | A |
| I-13 | phosphate-free granular detergent marketed in U.S.A. | | A | 98 | 15 | C |
| I-14 | phosphate-free granular detergent marketed in U.S.A. | | B | 97 | 2 | A |
| I-15 | 20 | 0 | 0 | 98 | 1 | A |
| I-16 | 0 | 20 | 0 | 98 | 8 | C |
| I-17 | 0 | 0 | 20 | 93 | 0 | A |
| I-18 | 5 | 5 | 10 | 96 | 5 | A |
| I-19 | 13 | 1.5 | 5.5 | 98 | 5 | A |
| I-20 | 2.5 | 15 | 2.5 | 98 | 20 | C |
| I-21 | 14 | 5 | 1 | 98 | 5 | A |
| I-22 | 10 | 7 | 3 | 98 | 8 | C |
| I-23 | 1 | 13 | 6 | 98 | 8 | C |
| I-24 | 10 | 10 | 0 | 98 | 20 | C |
| I-25 | 0 | 10 | 10 | 95 | 8 | C |
| I-26 | 10 | 0 | 10 | 95 | 2 | A |

(Remarks)
[1)]sodium $C_{14}$—$C_{15}$ alkyl sulfate
[2)]sodium $C_{14}$—$C_{18}$ α-olefin sulfonate
[3)]sodium $C_9$—$C_{11}$ polyoxyethylene alkyl ether sulfate (P = 4)

EXAMPLE 2.

(Influence of the number of carbon atoms of alkyl group and the average number P of ethylene oxide unit of AES)

Surface active agent as itemized:

| | |
|---|---|
| AS (the same as used in Example 1) | 8% |
| AOS (the same as used in Example 1) | 6% |
| AES (ones specified in the following table) | 6% |

| P | Properties | Number of carbon atoms of alkyl group | $C_6$–$C_8$ | $C_8$–$C_{10}$ | $C_{10}$–$C_{12}$ | $C_{12}$–$C_{14}$ |
|---|---|---|---|---|---|---|
| | Detergency | | 94 | 96 | 98 | 100 |
| 0 | Foam height at the time of cleansing (mm) | | 5 | 7 | 8 | 8 |
| | Easiness in rinsing | | A | A | A | A |
| | Detergency | | 95 | 99 | 100 | 100 |
| 1 | Foam height at the time of cleansing (mm) | | 6 | 17 | 20 | 20 |
| | Easiness in rinsing | | A | A | A | C |
| | Detergency | | 97 | 100 | 101 | 101 |
| 4 | Foam height at the time of cleansing (mm) | | 6 | 20 | 25 | 25 |
| | Easiness in rinsing | | A | A | A | C |
| | Detergency | | 97 | 99 | 100 | 101 |
| 8 | Foam height at the time of cleansing (mm) | | 5 | 15 | 20 | 20 |
| | Easiness in rinsing | | A | A | A | C |
| | Detergency | | 95 | 98 | 98 | 100 |
| 9 | Foam height at the time of cleansing (mm) | | 5 | 8 | 8 | 15 |
| | Easiness in rinsing | | A | A | A | C |

EXAMPLE 3.

(Influence of the number of carbon atoms of alkyl group of AS)

Surface active agent as itemized:

| | |
|---|---|
| AS (ones specified in the following table) | 8% |
| AOS (the same as used in Example 1) | 6% |
| AES (the same as used in Example 1) | 6% |

| Properties | Number of carbon atoms of alkyl group | $C_{12}$–$C_{13}$ | $C_{14}$–$C_{15}$ | $C_{16}$–$C_{17}$ |
|---|---|---|---|---|
| Detergency | | 97 | 99 | 95 |
| Foam height at the time of cleansing (mm) | | 8 | 20 | 5 |
| Easiness in rinsing | | A | A | A |

What is claimed is:

1. A granular detergent composition consisting essentially of from 20 to 40% by weight of a mixture of synthetic organic surface active agents and the balance of said composition consists essentially of detergent builder, with the proviso that said composition is free of phosphate detergent builder, said mixture of synthetic organic surface active agents consisting of (a) alkyl sulfate (AS) having the formula $ROSO_3M$, wherein R is alkyl having 14 to 15 carbon atoms on the average and M is alkali metal or alkaline earth metal, (b) alkali metal or alkaline earth metal α-olefin sulfonate (AOS) having 12 to 18 carbon atoms, and (c) polyoxyethylene alkyl ether sulfate (AES) having the formula $R'O(C_2H_4O)_nSO_3M'$, wherein R' is alkyl having 8 to 12 carbon atoms on the average, n is an integer of 1 to 8 and M' is alkali metal or alkaline earth metal wherein the proportions of AS, AOS and AES lie within the hatched polygonal area bounded by points a, b, c, d, e and f in the attached drawing.

2. A mixture of synthetic organic surface active agents consisting of (a) alkyl sulfate (AS) having the formula $ROSO_3M$, wherein R is alkyl having 14 to 15 carbon atoms on the average and M is alkali metal or alkaline earth metal, (b) alkali metal or alkaline earth metal α-olefin sulfonate (AOS) having 12 to 18 carbon atoms, and (c) polyoxyethylene alkyl ether sulfate (AES) having the formula $R'O(C_2H_4O)_nSO_3M'$, wherein R' is alkyl having 8 to 12 carbon atoms on the average, n is an integer of 1 to 8 and M' is alkali metal or alkaline earth metal wherein the proportions of AS, AOS and AES lie within the hatched polygonal area bounded by points a, b, c, d, e and f in the attached drawing.

* * * * *